US006125616A

United States Patent [19]

Brown

[11] Patent Number: 6,125,616

[45] Date of Patent: Oct. 3, 2000

[54] LOAD LEVELING SADDLE PAD

[75] Inventor: Roy L. Brown, Nevada, Mo.

[73] Assignee: Ortho-Flex Saddle Company, Inc., Nevada, Mo.

[21] Appl. No.: 09/212,749

[22] Filed: Dec. 16, 1998

[51] Int. Cl.[7] ..... B68C 1/12

[52] U.S. Cl. ..... 54/66

[58] Field of Search ..... 54/65, 66

[56] References Cited

U.S. PATENT DOCUMENTS

| | | | |
|---|---|---|---|
| 530,864 | 12/1894 | Torrey | 54/66 |
| 4,745,734 | 5/1988 | Brown . | |
| 4,969,316 | 11/1990 | Brown | 54/49 |
| 5,058,367 | 10/1991 | Evertson | 54/66 |
| 5,119,618 | 6/1992 | Streck | 54/66 |
| 5,175,986 | 1/1993 | Farley | 54/66 X |
| 5,343,674 | 9/1994 | Brown | 54/44.1 |
| 5,349,805 | 9/1994 | Brown | 54/35 |
| 5,383,328 | 1/1995 | Brown | 54/44.3 |
| 5,398,488 | 3/1995 | Brown | 54/47 |
| 5,435,116 | 7/1995 | Brown | 54/44.5 |
| 5,503,894 | 4/1996 | Brown | 54/34 X |
| 5,802,823 | 9/1998 | Woods | 54/66 |

FOREIGN PATENT DOCUMENTS

| | | | |
|---|---|---|---|
| 90/00518 | 1/1990 | WIPO | 54/66 |

*Primary Examiner*—Robert P. Swiatek

*Attorney, Agent, or Firm*—Hovey, Williams, Timmons & Collins

[57] ABSTRACT

A load leveling saddle pad for placement on the back of an equine animal such as a horse or mule beneath the saddle which uses a load leveler to fill depressions behind the scapula thereby building a more even surface for the bearing load. The saddle pad includes a pair of interconnected aprons which extend over the ribs and shoulders of the animal, with the load leveler being positioned on the aprons for positioning behind the scapula of the animal, the load leveler including at least one shim and an attachment member which releaseably couples the shim to the apron. Preferably, a thin bridging material is used to connect the aprons along their respective top edges to avoid pinching of the animal, with holes provided along the upper ridge thereof for ventilation. A plurality of shims are preferably provided in stacked, stairstepped relationship to avoid pressure transmission to the musculature of the animal and distribute the load, with each shim being releaseably and adjustably connected to the shim or apron therebeneath. Hook and loop fabric, such as Velcro®, is preferably used to permit releasable and adjustable coupling of the thin padded shims to provide proper load leveling of the horse's back to accept the saddle.

15 Claims, 2 Drawing Sheets

LOAD LEVELING SADDLE PAD

BACKGROUND OF THE INVENTION

1. Field of the Invention

This invention broadly concerns pads for placement between the back of a ridden or pack-bearing animal such as a horse or mule and a saddle to distribute the weight applied from the saddle to the horse. More particularly, this invention is concerned with a saddle pad which reduces the pressure applied to the horse's back by providing inserts to adjust the load application, which reduces pinching in the area of the horse's withers, and which provides ventilation through openings in the pad.

2. Description of the Prior Art

Thus use of padding between a horse or mule and a saddle is a common, if not a virtually essential practice. Such padding includes boots of sheepskin or foam attached to the skirts of the saddle, or more commonly a pad or blanket which is placed over the horse's back before placement of the saddle. Blankets are commonly provided of wool because of its durability and Navajo wool blankets have long been used by western riders. Saddle pads are similar to blankets, often being somewhat softer and thicker.

The saddle blankets and pads are usually of uniform thickness. Some attempts to introduce more modern materials into saddle pads have been undertaken, with hydrogel, open-cell foam and closed-cell foams being employed, as well as air as a cushioning medium. These pads have commonly focused on the cushioning effect of the pad, and provide improvement in reducing friction between the saddle and the horse's back.

However, the use of these more modern materials also results in drawbacks. For example, hydrogel is a heavy material that traps heat generated by the working horse beneath the pad, and is not suitable for conforming rapidly to the horse's back during movement. Foams, if dense enough to provide adequate durability, transfers the pressure from the saddle tree deep into the horse's muscle tissue with sufficient magnitude to cut-off circulation. Wool felt has been used, but is more structural rigid, and thus provides little padding.

As a result, riders may use 2 or 3 pads or a single very thick pad, thinking this will prove more comfortable to the horse. In actuality, this may result in severe pinching of the horse's trapezius muscle where it is attached at the vertebral "Spinous Processes" in the thoracic area, also known as the withers. Furthermore, the use of the extra pad or extra-thick padding may reduce the available space left under the front of the saddle. As a result, excessive pressures develop beneath the pad because of its thickness.

A further drawback of existing padding is the inability to lessen pressure or impingement on the rotating scapulas of the horse by the saddle tree. The placement of the saddle blanket or pad over the flexing muscles and moving scapula of the horse may result in substantial discomfort. Existing blankets and pads also fail to compensate for the asymmetrical animal whose back is shaped differently from one side to another.

Thus, while existing pads and blankets aid in reducing the friction between the horse and saddle, they try to provide a "one-size-fits-all" approach without compensation for the configuration of different horses, do not sufficiently lessen pressure or impingement to localized areas on the horse's back, and may pinch in the area where the saddle fork meets the side rails over the horse's withers.

SUMMARY OF THE INVENTION

These and other problems are largely solved by the load leveling saddle pad of the present invention. That is to say, the saddle pad according to the present invention is provided with inserts or shims which are configured to eliminate high pressures transmitted by the saddle by distributing the load rearwardly of the scapula without impingement or excess thickness in the pad, and by providing adjustability in thickness and location to allow the skirt to conform to horses of different sizes, asymmetrical horses or those with atypical configurations. Furthermore, the load leveling saddle pad hereof most preferably provides adequate cushioning and load distribution by an apron of increased rigidity without pinching in the area of the withers or trapping heat below the pad. The load leveling pad is also most preferably provided a thin bridging material for spanning the horse's spine and connecting the padded aprons, the bridging material preferably being provided with one or more openings for providing ventilation to allow heat to escape between the horse's back and the saddle.

The saddle pad hereof broadly includes a pair of padded aprons interconnected by a bridge of relatively thinner, more flexible material. The aprons are preferably provided with one or more leveling shims removably and adjustably attached to the apron, which permit the shims to be properly positioned to distribute loads applied behind the horse's scapulae. The shims are most preferably provided as rounded flexible, cushioned members with multiple shims in stacked relationship, each shim presenting a smaller surface area than the shim therebeneath. The shims are preferably retained by a fastener, such as a strip of hook and loop material, affixed to each shim to permit positioning of the attachment as desired to the shim immediately therebeneath.

Most preferably, the load leveling saddle pad hereof includes an attachment member to receive the shims on each of the aprons, the attachment member including snaps, buttons, hook and loop fabric or the like which permit releasable and adjustable placement of the shims on the aprons in the area to the rear of, i.e. behind the horse's scapulae. A pocket of durable material such as leather or a synthetic resin fabric like nylon or Cordura® is secured to the apron to receive the shims therein in a protecting relationship. The pocket is most preferably stitched or otherwise secured to the apron, with a portion of the pocket also releaseably attached using hook and loop fasteners, snaps or buttons to provide easy access for viewing the positioning of the shims within the pockets.

As a result, a lightweight but durable saddle pad is provided which permits leveling of the load bearing surface of the horse's back, protects the scapulae of the horse by distributing the load applied to the pad through the shims, avoids pinching of the horse in the area adjacent the withers and below the fork of the saddle. These and other advantages will be readily appreciated by those skilled in the art with reference to the drawings and written description of the preferred embodiment set forth below.

DESCRIPTION OF THE PREFERRED EMBODIMENT

Figure 2:
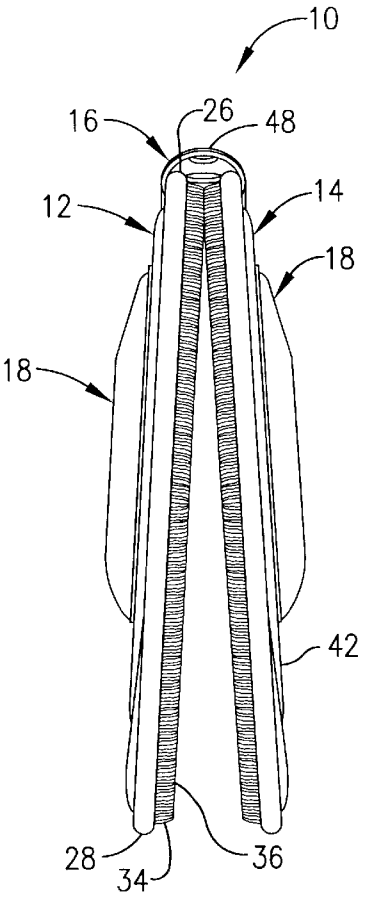
FIG. 2 is a front end elevational view of the load leveling saddle pad hereof taken along line 2—2 of FIG. 1.

Referring now to the drawing, a load leveling saddle pad 10 in accordance with the present invention broadly includes a first apron 12 and a second apron 14 joined together by a flexible bridging member 16. A load leveler 18 is provided on each of the aprons 12 and 14 on the forward half thereof and roughly midway vertically on each apron for positioning over the shoulders or scapulae of the horse on which the pad 10 is placed.

In greater detail, the aprons 12 and 14 are each substantially flat padded panels 20 having a front edge 22, a rear edge 24, a top edge 26 and a bottom edge 28. The panels 20 may be provided of a variety of suitable materials which provide a measure of padding, such as leather with a fleece backing, thin foam or encapsulated gel, or woven fabric mats. The panels 20 of the preferred embodiment are shown as having two plys 30 and 32 of woven synthetic resin pile cloth on a backing in the manner found in nylon carpeting, with natural or synthetic resin fleece 34 sewn on the inside face 36 of the panels to provide relief from friction, giving the aprons a thickness T of about 1 inch when the fleece 34 lays flat. A border 38 of durable material such as leather or synthetic resin cloth surrounds the edges 22, 24, 26 and 28 to finish the apron and protect against fraying. A guard 40 of leather or synthetic resin is preferably sewn to the outside face 42 of the panels 20 along the bottom edge 28 to protect against wear.

Bridging member 16 is a thin, flexible and durable web most preferably sewn but possible adhesively bonded to each of the aprons 12 and 14 adjacent their respective top edges 26. The bridging member 16 preferably has a thickness B of less than one-fourth and preferably less than one-eighth of the thickness of the panels 20 of the aprons 12 and 14 to avoid binding or pinching of the horse along the spine and adjacent its withers when the saddle is cinched on the horse. Leather, or alternatively durable synthetic resin material such as Cordura® may be used as the material for the web of the bridging member 16. The bridging member 16 is preferably provided with a plurality of openings 46 in the web along the upper ridge 48 thereof caused by the depending aprons 12 and 14, each of the openings preferably being circular or oval to avoid tearing and at least about ½" or more in diameter to permit significant ventilation. Alternating smaller holes 50 having a diameter of between ½" and 1" and larger holes 52 of a diameter of at least about 1" are most preferably provided, separated by unperforated regions 54 which are also provided at the front end 56 and rear end 58 of the bridging member 16.

Figure 3:
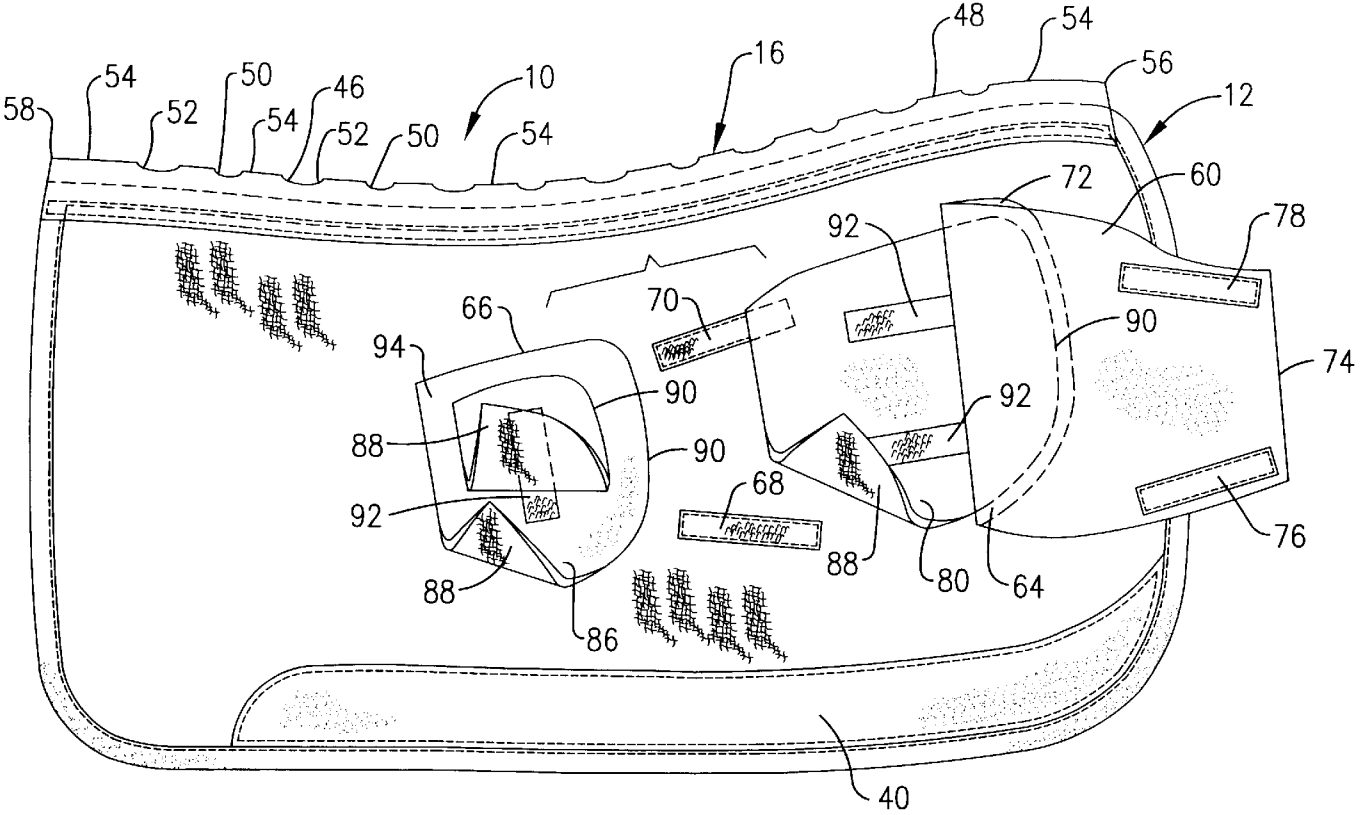
FIG. 3 is a left side elevational view similar to FIG. 1, with two of the stacked shims shown in exploded relationship and the covering pocket pulled back to show the attachment member.

The load leveler 18 includes a flap 60 secured by stitching 62 or the like to the aprons 12 and 14 to provide a pocket 64, one or more shims 66 received within the pocket 64, and attachment members 68 and 70 which preferably both releaseably and adjustably attach the shims 66 to the aprons 12 and 14 and also help to hold the flap 60 against the aprons. The flap 60 forming the pocket 64 therebeneath is preferably a sheet of leather or durable synthetic resin material having an arcuate front margin 72 and extending rearwardly to rear margin 74. The stitching 62 is preferably provided adjacent the front margin 72 to inhibit detachment of the flap 60 from the apron 12 or 14 to which it is secured, but to permit the rear margin 74 to be pulled forwardly in the manner of a flap as shown in FIG. 3. The flap 60 is provided with loop fabric portions 76 and 78 for releasable attachment to the attachment members 68 and 70 to hold the rear margin 74 closed. The shims 66 preferably include a first shim element 80 of a relatively larger area for positioning adjacent the outside face 42, a second shim element 82 of an intermediate area for positioning over the first shim element 80, and a third shim element 84 of a relatively smaller area for positioning over the second shim element 82. It is to be understood that one, two or all three shim elements may be employed on each apron 12 and 14 as desired to properly level the load and adjust the orientation of the saddle on the horse. The attachment members 68 and 70 are preferably of a hook and loop material such as Velcro®, and less desirably a plurality of snaps or other fasteners which provide less adjustability and do not permit the attachment members to both releaseably couple with the shims 64 and the flap 60.

Figure 4:
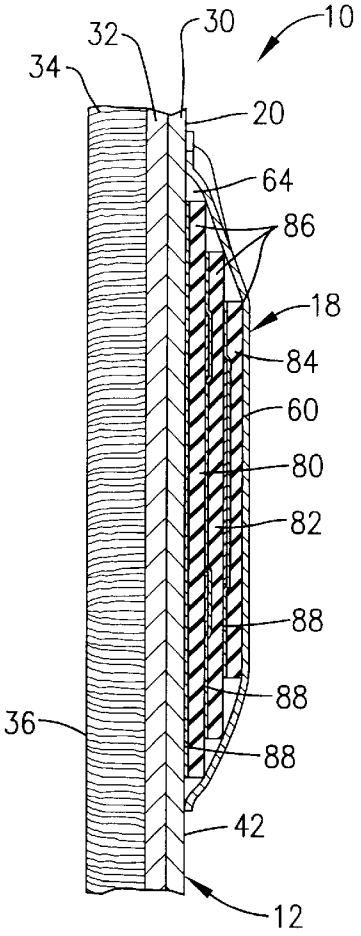
FIG. 4 is a firagmentaiy, vertical cross-sectional view taken along line 4—4 of FIG. 1 showing the stacked positioning of the shims and the provision of the loop fabric on the back side of each shim to permit adjustable placement of the shims within the pocket.

Each shim element 80, 82 and 84 is preferably provided of a relatively thin, flexible, padded material such as closed cell foam 86 such as Neoprene to which a loop fabric backing 88 is adhesively attached. Alternatively, snaps or button holes could be provided in the shim elements, although this would provide a reduction in the ability to precisely adjust the shim elements within the pocket 60. Each of the shim elements 80, 82 and 84 presents an arcuate forward edge 90 to better conform to the horse's anatomy and avoid transmission of pressure as a point source to the horse. Strips 92 of hook fabric are adhesively attached to the outer surfaces 94 of shim element 80 and shim element 82 to permit the releasable and adjustable attachment of the loop fabric backing 88 of the respective overlying shim element 82 and 84 thereto as shown in FIG. 4. Because of the cooperation between the strips 92 and the loop fabric backing 88, the shim elements 80, 82 and 84 may be adjusted forward and back, as well as up and down relative to one another and once placed in the desired positions to fill in the hollow behind the horse's shoulders and provide a desired, even distribution of weight, the shim elements being held to one another and to the panel by the interengagement of the hook and loop fabric connection and further retained within the pocket 64 by the flap 60.

Figure 1:
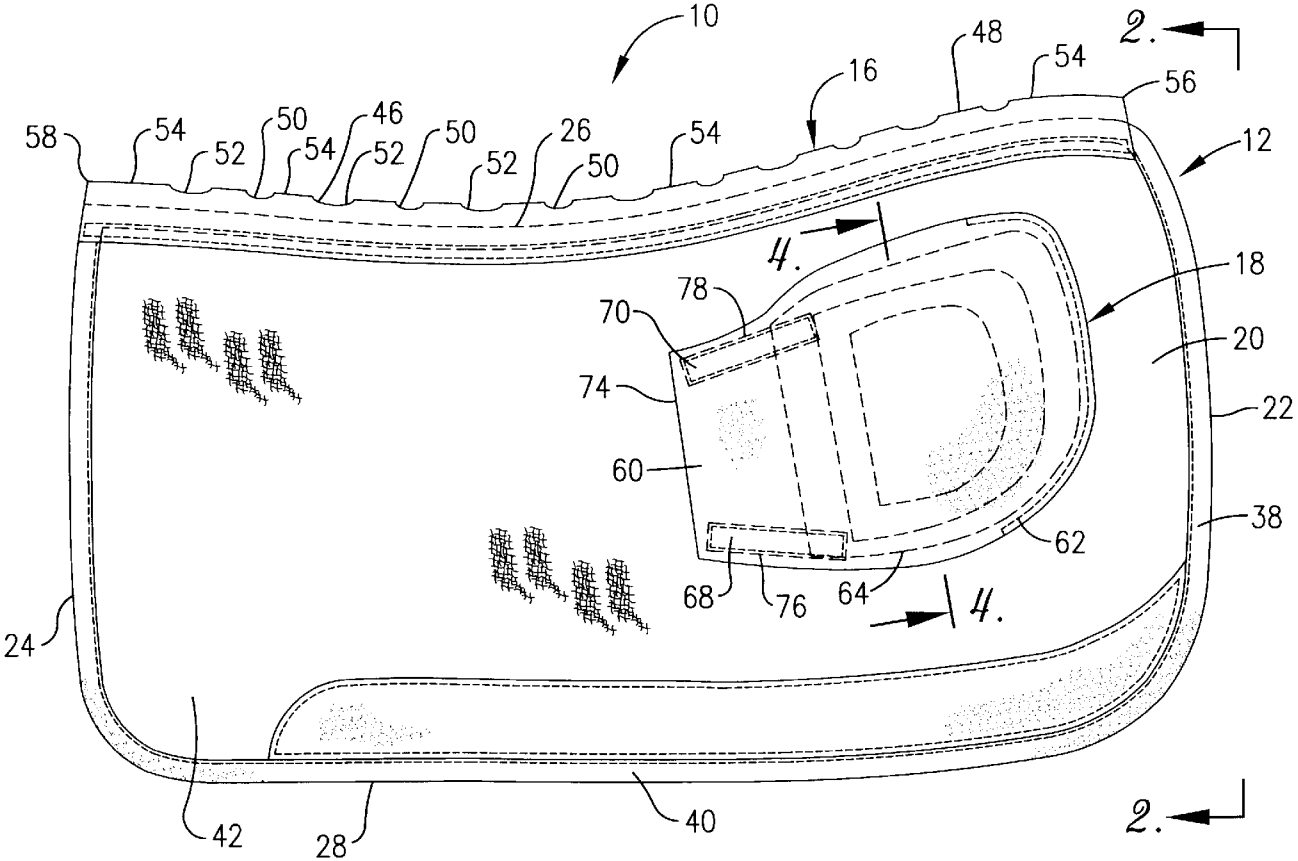
FIG. 1 is a left side elevational view of the load leveling saddle pad in accordance with the present invention in an assembled condition ready for placement on a horse.

In use, the load leveling saddle pad 10 is placed on the back of the horse with the front end 56 located forwardly of the withers of the horse and each of the aprons 12 and 14 over the respective right and left ribs of the horse. This positions the bridging member over the horse's spine. The flap 60 is opened as shown in FIG. 3 and one or more shims 64 are inserted beneath the flap. The lowermost and largest shim element 80 is held in place both by the flap 60 which is secured to the apron at its front margin 72 and by the interconnection between the loop fabric backing 88 with the hook material of the attachment members 68 and 70. The shim element 80 is preferably sized so that not all of the attachment members 68 and 70 are covered by the shim element 80, thereby permitting connection of the loop fabric portions 76 and 78, sewn or adhered by adhesive to the inside of the flap 60, with the exposed portions of the attachment members 68 and 70 when the flap 60 is folded back to the position shown in FIG. 1. For a symmetrically configured horse, shim elements 82 and 84 are inserted in stacked relationship over the shim element 80 so that the area of each smaller shim element is within the boundary defined by the edge of the shim therebeneath, as shown in dashed lines in FIG. 1. The shim elements 80, 82 and 84 when inserted into the pocket 64 are then structural a part of the pad 10, but may be removed and repositioned as desired in the concave area behind the shoulders until positioned beneath the front fork and side rails of the saddle tree of the saddle placed thereon to receive and distribute the load transmitted thereby. When the horse is asymmetrically configured, then one or more shim elements may be removed from the pocket 64 so that the load bearing surface of the horse is more symmetrical. The saddle is then placed over the saddle pad 10 and the girth cinched so that the horse is ready for riding or to receive a load when the saddle is a pack frame.

When properly positioned with a properly fitted saddle, the saddle pad 10 provides a space between the bridging member 16 and the gullet and seat of the saddle so that air can circulate therethrough. By providing a reduced thickness of the bridging member relative to the aprons, the pad does not gather and pinch in the area of the withers where the pad 10 must bend to conform to the animal. The transmission of pressure to the moving shoulders of the horse is reduced by providing stair-stepped padding and progressive load distribution behind the shoulders, and the saddle may be properly oriented to a horse of an asymmetric configuration by selective use of the shim elements. Finally, the shim elements may be infinitely adjusted within the pocket 64 so that different saddles and different horses may be accommodated using the same pad 10 and present a definite advantage over simply using a thicker pad or multiple pads.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. One such example is that the hook fabric attachment members 68 and 70 and strips 92 could be provided of loop fabric, with the backing 88 and loop fabric portions 76 and 78 instead provided of hook fabric and still retain the adjustment capability of the shim elements as recited herein. Furthermore, the type of material used for the panels 20 may be The inventor hereby states his intent to rely on the Doctrine of Equivalents to determine and assess the reasonably fair scope of his/their invention as pertains to any apparatus not materially departing from but outside the literal scope of the invention as set out in the following claims.

What is claimed is:

1. A saddle pad for positioning beneath a saddle worn by an equine animal comprising:

interconnected first and second side aprons each presenting a corresponding apron surface area and configured for positioning over the ribs and shoulders of the animal; and a load leveler attached to the exterior surface of at least one of said first and second aprons, said load leveler including at least one shim presenting a shim surface area and an attachment member releasably and adjustably coupling said at least one shim to said apron, said shim surface area being less than one-half of the corresponding apron surface area.

2. A saddle pad as set forth in claim 1, including a thin flexible bridging member for interconnecting said aprons.

3. A saddle pad as set forth in claim 2, wherein said aprons have a first thickness and said bridging member has a second thickness, the ratio of said first thickness to said second thickness being at least 4:1.

4. A saddle pad as set forth in claim 1, wherein said at least one shim includes first and second shim elements in stacked relationship.

5. A saddle pad as set forth in claim 4, including means releaseably interconnecting said second shim element to said first shim element.

6. A saddle pad as set forth in claim 5, wherein each of said first and second shim elements have a loop fabric backing and an outer surface, said interconnecting means including a strip of hook material on the outer surface of the first shim element.

7. A saddle pad as set forth in claim 4, wherein said first shim element has an area greater than said second shim element received thereon.

8. A saddle pad as set forth in claim 4, including a flap secured to each of said aprons defining a pocket for receiving said shim elements therein.

9. A saddle pad as set forth in claim 8, wherein said aprons each include a top edge, a bottom edge, a front edge and a rear edge and said pocket is positioned substantially intermediate said top edge and said bottom edge and more proximate said front edge than said rear edge.

10. A saddle pad for positioning beneath a saddle worn by an equine animal comprising:

interconnected first and second side aprons configured for positioning over the ribs and shoulders of the animal; and a load leveler attached to the exterior surface of at least one of said first and second aprons, said load leveler including at least one shim of a smaller area than said apron and an attachment member releasably and adjustably coupling said at least one shim to said apron, said at least one shim including first and second releasably interconnected shim elements in stacked relationship.

11. The saddle pad as set forth in claim 10, including separate hook and loop material respectively secured to said first and second shim elements in order to releasably interconnect the same.

12. The saddle pad as set forth in claim 10, wherein said first shim element has a greater surface area than said second shim element.

13. A saddle pad for positioning beneath the saddle worn by an equine animal comprising:

first and second aprons for positioning over the ribs and shoulders of the animal, each of said first and second aprons having a first thickness and presenting a top edge;

a bridging member interconnecting said first and second aprons and secured adjacent the respective top edges thereof, said bridging member being of a flexible material having a second thickness, wherein the ratio of said first thickness to said second thickness is at least 4:1; and a load leveler attached to at least one of said first and second aprons, said load leveler including first and second releasably interconnected shim elements in stacked relationship.

14. The saddle pad as set forth in claim 13, including separate hook and loop material respectively secured to said first and second shim elements in order to releasably interconnect the same.

15. The saddle pad as set forth in claim 13, wherein said first shim element has a greater surface area than said second shim element.

* * * * *